US005257465A

United States Patent [19]

Marx, Jr.

[11] Patent Number: 5,257,465

[45] Date of Patent: Nov. 2, 1993

[54] ROPE STRETCHER FOR PAPER MAKING PROCESS

[76] Inventor: Edmund N. Marx, Jr., 102 E. Weed St., St. Mary's, Ga. 31558

[21] Appl. No.: 869,157

[22] Filed: Apr. 14, 1992

[51] Int. Cl.[5] ..... F26B 19/00

[52] U.S. Cl. ..... 34/60; 34/117

[58] Field of Search ..... 34/117, 120, 123, 116, 34/114, 12, 60

[56] References Cited

U.S. PATENT DOCUMENTS 5,050,317 9/1991 Kade et al. ..... 34/117

*Primary Examiner*—Henry A. Bennet

*Attorney, Agent, or Firm*—Arthur G. Yeager

[57] ABSTRACT

An apparatus for continuously receiving two or more guide ropes, separately stretching those ropes and returning them to be joined for guiding purposes; the apparatus including a sliding carriage for each rope, a pulley on each carriage, a cable attached to each carriage with adjustable means to apply tension to the cable and thereby to the rope, and pulleys to lead the ropes into and out of the apparatus.

20 Claims, 3 Drawing Sheets

ROPE STRETCHER FOR PAPER MAKING PROCESS

TECHNICAL FIELD OF THE INVENTION

This invention relates to an apparatus for use in a Fourdrinier paper process to continuously stretch separately the ropes employed to drive dryer cans and continuously recombine the stretched ropes to the drive system.

BACKGROUND OF THE INVENTION

In a Fourdrinier paper making process a sheet of fibers is laid on a travelling screen and subjected to drainage and vacuum dewatering and then passed over a series of rotating heated drums (dryer cans) to evaporate the water content to about 5% which is suitable for finishing, and prepared in rolls for sales. The paper sheet is guided through the series of dryer cans by endless ropes that are seated in a groove at one end of the can similar to a pulley. The endless ropes are usually used in combinations of 2 or 3 ropes simultaneously fitting into the one groove around each can. This is for the purpose of providing a means for gripping one edge of the travelling sheet of paper as it passes through the series of dryer cans. As the rope is used, its water content changes, and the rope, usually made of braided fibers of nylon or other fibrous material, stretches and shrinks as it passes through the various stresses of pulling the paper over several dryer cans. It has been a routine processing step to pass the ropes leaving the last can of the series through a rope stretching step so as to remove as much of the strains and length changes in the rope as possible before returning the ropes to the first can in the series.

In the past, the rope stretchers involve pulleys mounted on a travelling support that slides or rolls on a vertical track supported by L-shaped arms attached to a rigid base. Because the pulley over which the rope runs is supported on one side only (by one track and one set of arms) the tension forces on the pulley tend to apply a torque to the pulley and its support, and the torque produces undesirable stresses and strains in the rope and in the rope stretching device.

It is an object of this invention to provide a novel improved rope stretching device. It is another object to provide an improved rope stretching device that has no torque applied to the rope or to the stretching device. Still other objects will become apparent from the more detailed description which follows.

BRIEF SUMMARY OF THE INVENTION

This invention relates to an improvement in the rope stretching apparatus in a Fourdrinier paper making process. The improvement comprises a rigid immovable frame having a plurality of elongated parallel tracks each said track containing a reversing pulley mounted on a carriage movable lengthwise along said track and adapted to engage one said rope and cause its direction of travel to change through 180°; an entrance guide pulley adapted to receive said rope from the last in said series of dryer cans and direct it into said reversing pulley; and an exit pulley adapted to receive said rope from said reversing pulley and direct it to the first of said series of dryer cans; and means to apply an adjustable force to each said carriage which produces tension in said rope travelling between said entrance pulley and said exit pulley.

In specific and preferred embodiments of the invention the ropes are separated and stretched separately and returned to be combined at the upstream end of the dryer can series in an elongated tapering converging arrangement so as to provide a nip therebetween for receipt of one edge of the travelling paper sheet. In another such embodiment impact bumpers are included at the ends of the tracks to absorb any impact damage by the carriages in the event of rope or cable breakage. In still another embodiment the carriage is supported on both sides by a trapezoidally shaped sliding block or by tapered wheels fitting into the concave spaces in the faces of the beams forming the track.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of this invention are best understood by reference to the attached drawings.

Figure 1:
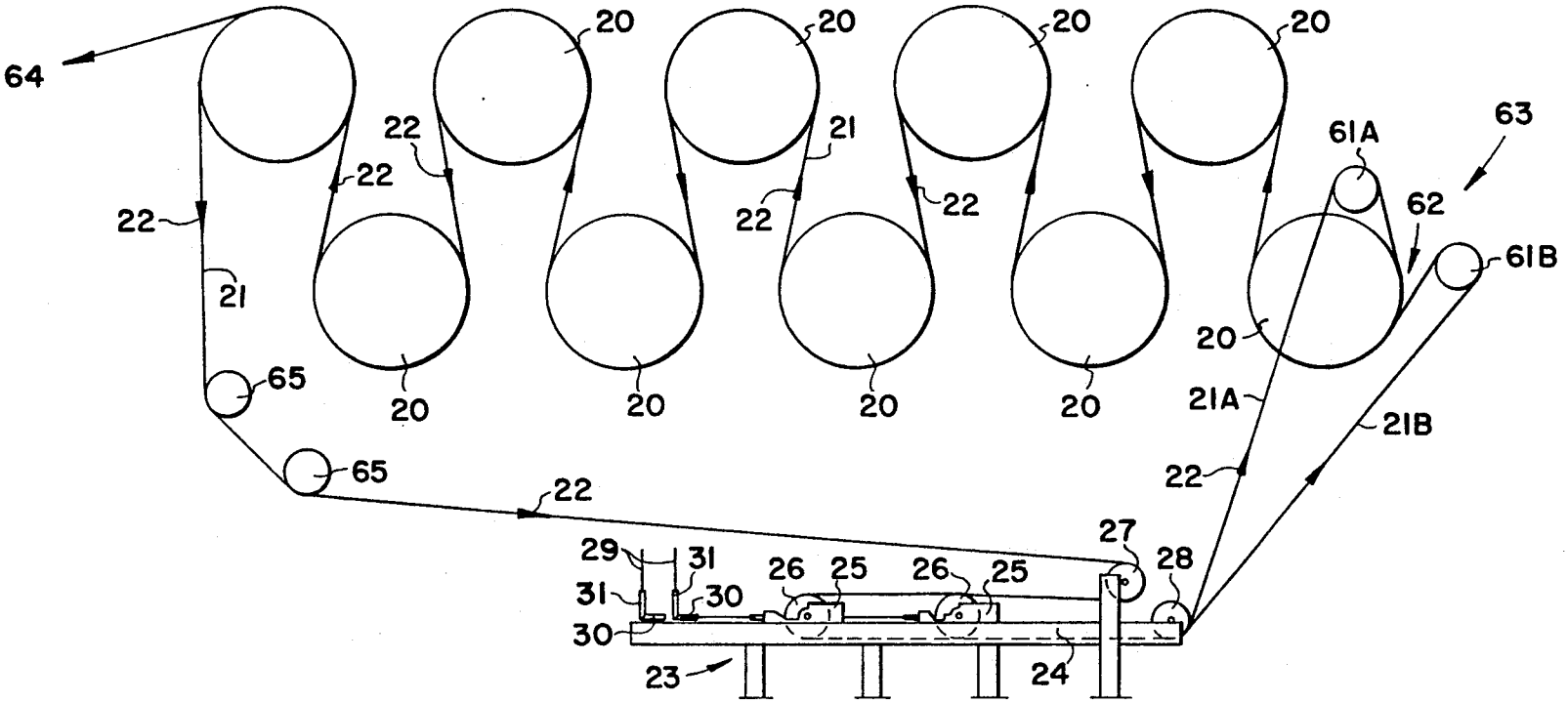
FIG. 1 is a schematic flow sheet showing where this invention fits into the paper making process.

In FIG. 1 there is shown the general system of employing the applicant's invention in a Fourdrinier paper making process. After the initial formation of a web of fibers in a Fourdrinier moving screen, the web is dewatered in a press section down to about 50–60% moisture, and then subjected to evaporation in a dryer section where the moisture is reduced to about 5%. The dewatered paper at 63 is fed into a nip 62 which leads the wet paper sheet over a series of heated rolls (called "dryer cans") 20 and eventually leaves the last dryer can 20 of the series at 64 to be finished and wound into rolls for storage and sale. At the same end of each dryer can 20 there is a convex groove or flange of U-shape or V-shape functioning as a guide for a plurality, usually 2 or 3, separate endless rope loops 21 travelling in the direction of arrows 22. An edge of the wet paper sheet is gripped between these loops and thereby guides the paper sheet over each dryer can in the entire series (20–120 cans). After leaving the last dryer can 20 in the series the ropes 21 are returned to the first dryer can 20 in the series, but on the way the ropes 21 are passed through a rope stretching apparatus 23, wherein the plurality of ropes are separated to single ropes, stretched as single ropes, and then recombined as a plurality of ropes forming the nip 62.

Figure 12:
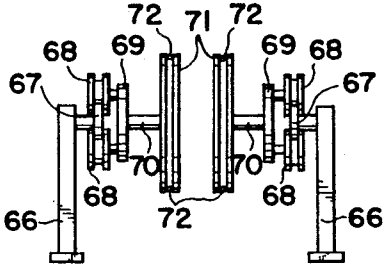
FIG 12 PRIOR ART
FIG. 12 is an end elevational view of a rope stretching apparatus of the prior art.
Figure 7:
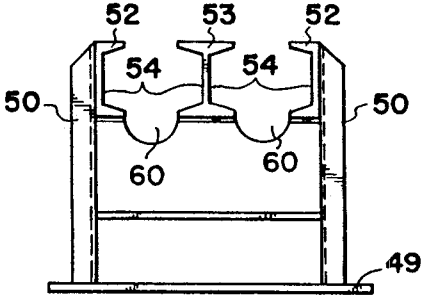
FIG. 7 is a cross-sectional view taken at 7—7 of FIG. 4.
Figure 11:
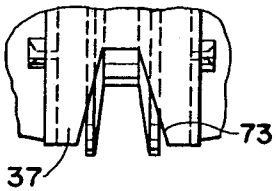
FIG. 11 is a partial front elevational view of the travelling carriage of this invention.
Figure 10:
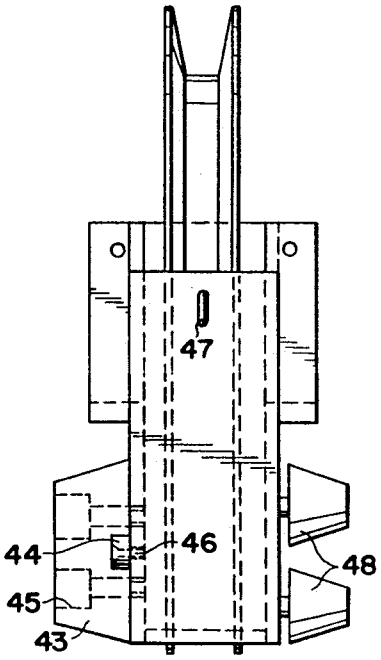
FIG. 10 is a rear elevational view of the travelling carriage of this invention.
Figure 8:
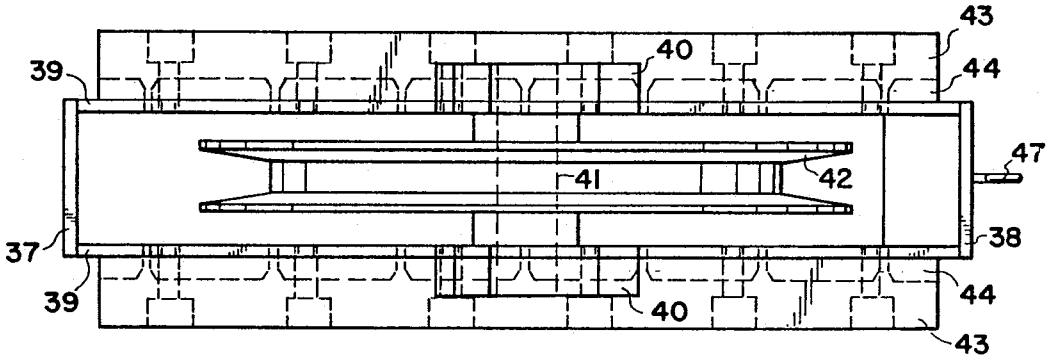
FIG. 8 is a top plan view of the travelling carriage of this invention.
Figure 9:
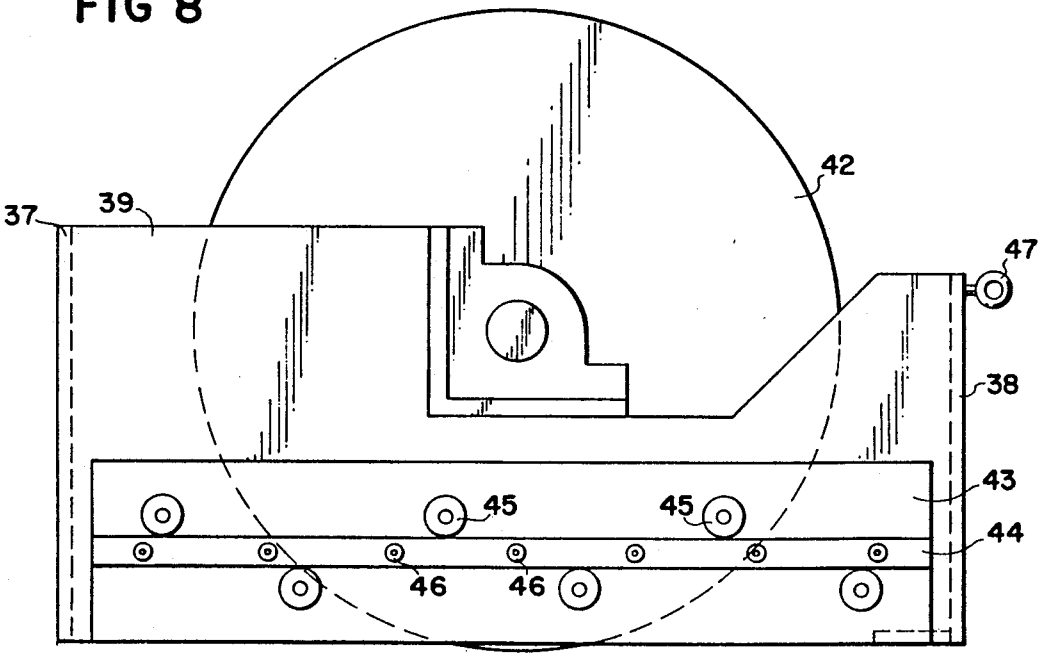
FIG. 9 is a side elevational view of the travelling carriage of this invention.

In FIG. 12 there is shown a typical apparatus of the prior art for rope stretching two ropes simultaneously. Each stretcher includes a frame or support beam 66 having a strip 67 serving as a track attached to the support beam 66. Wheels 68 are grooved to engage track 67. Wheels 68 are attached to a movable carriage 69 which in turn carries a shaft 70 around which rotates a pulley 71 with rope 72 in the pulley recess. Rope 72 is the same as rope 21 in FIG. 1 coming from and returning to the dryer cans 20 in the series. Each carriage 69 is attached to a restraining cable (not shown) which can be tensioned so as to apply a tension force to rope 72 causing it to be stretched. The principal difficulty with the prior art stretching device is that pulley 71 is supported from one side only and the tension forces applied to rope 72 tend to twist pulley 71 because of its lateral distance from frame 66. This applies stresses and strains to carriage 69, wheels 68, and track 67 which eventually cause damage to these parts and to rope 72.

Figure 3:
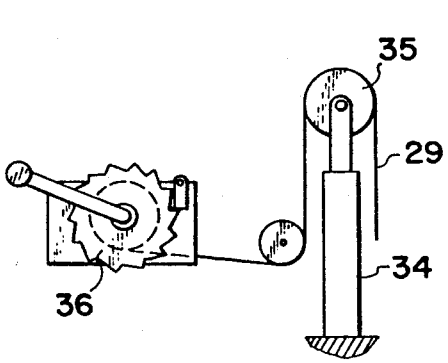
FIG. 3 is a schematic illustration of a second method for tensioning the restraint cable of the rope stretching apparatus of this invention.
Figure 2:
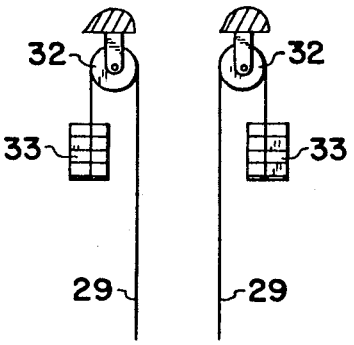
FIG. 2 is a schematic illustration of one method for tensioning the restraint cable of the rope stretching apparatus of this invention.
Figure 4:
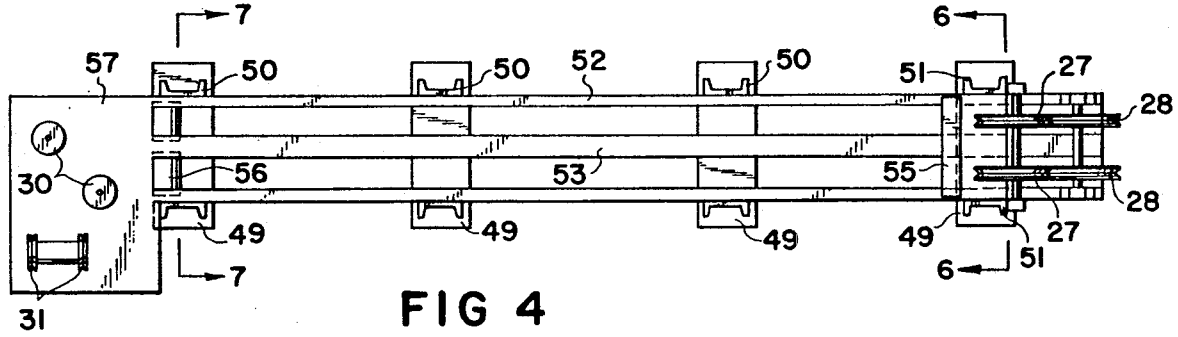
FIG. 4 is a top plan view of the support frame and tracks of this invention.
Figure 5:
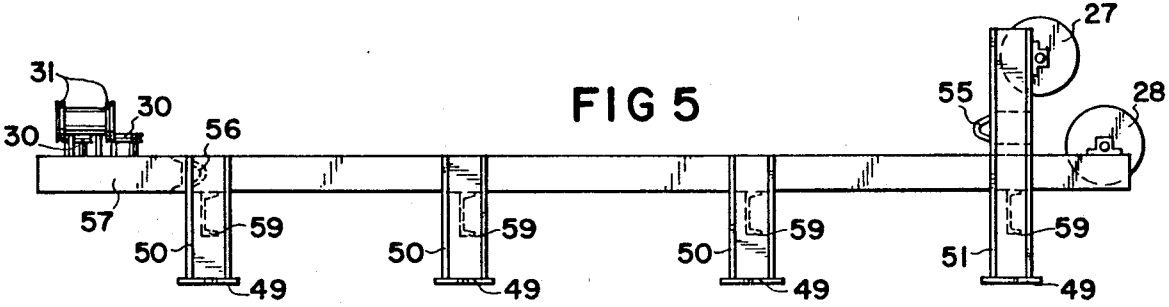
FIG. 5 is a front elevational view of the support frame and tracks of this invention.
Figure 6:
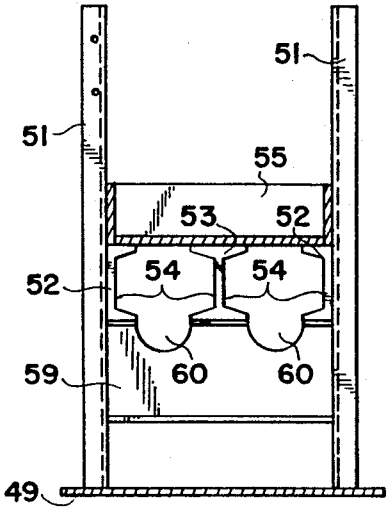
FIG. 6 is a cross-sectional view taken at 6—6 of FIG. 4.

In the present invention rope stretching apparatus 23 has a separate carriage 25 for each rope in the combined strands 21. Each carriage 25 is supported from both sides so as to eliminate all torque stresses in the apparatus and to allow for proper stretching and cleaning of rope 21. The tension forces on rope 21 are applied by a restraining cable 29 attached to each carriage 25 and directed by pulleys 30 and 31 to a suitable means for tensioning cable 29. One such means is shown in FIG. 2 where weights 33 and gravity apply the force by passing cable 29 over pulleys 32. The force is adjustable by permitting the addition or subtraction of weights 33 to reach any desired force. Another means is shown in FIG. 3 where a cylinder, hydraulic or pneumatic, is employed to push pulley 35 upward against cable 29 which is fastened to hand crank winch 36 for fine adjustment of the tensioning force.

In FIGS. 4–7 there is shown the supporting frame and tracks for the apparatus of this invention. Two tracks are shown as the combination of two horizontal channel beams 52 spaced laterally outwardly from a central I-beam 53. In the spaces between each channel beam 52 and the central I-beam 53 the movable carriage of FIGS. 8–11 travels horizontally and longitudinally. These beams are held together in a parallel relationship by spaced vertical legs 50 and by base plates 49. At the forward end of the supporting frame there are mounted an entrance pulley 27 and an exit pulley 28 to guide each single rope into and away from the stretching zone. Across the forward end of the tracks there is an impact bumper 55 and across the rearward end of the tracks there is an impact bumper 56. These bumpers 55 and 56 may separate for each track or they may be a single bumper across both tracks. Preferably, the bumpers are made in a pillow form and are a rubbery material. They may however be a more complicated structure of shock absorbing components. Bumpers 55 and 56 are needed to catch the carriages 25 should rope 21 or cable 29 break. Cutouts 60 are shown in lateral beams 59 to provide room for the return stretch rope to travel from the carriage (FIGS. 8–11) to exit pulley 28 and thence back to dryer cans 20. Legs 51 are longer than legs 50 so as to provide clearances for bumper 55 and entrance pulleys 27.

In FIGS. 8–11 there are shown the movable carriages which travel in the tracks of the support frame of FIGS. 4–7. Each carriage 25 has a pulley 26 around which rope 21 loops as it travels from entrance pulley 27 to exit pulley 28. Carriage 25 is a four-sided box having a front wall 37, a rear wall 38, and two side walls 39. Pulley is positioned centrally between side walls 39 and is rotatably supported by shaft 41 journaled in a bearing in bearing blocks 40. On each side wall 39 there is mounted a convex guide means that corresponds closely in cross section to the concave space 54 formed by the face of each channel beam 52 and by each side of the I-beam 53. The convex guide means for carriage 25 may be a solid trapezoidally shaped strip 43 or a plurality of tapered rollers 48 (see FIG. 10). The strip 43 and the rollers 48 are preferably made of a low-friction material such as plastic (polyamide, polyfluorocarbon, polyolefin, etc.). If the strip 43 is employed it may be desirable to employ a guide key 44 to mate with a corresponding groove in strip 43 so as to locate strip 43 accurately. Screws 45 and 46 may be used to attach strip 43 and key 44 to carriage 25. An eyebolt 47 is attached to rear wall 38 for attachment of tension cable 29 to carriage 25. A cutout 73 is made in front wall 37 (FIG. 11) to provide room for rope 21 to pass from pulley 42 to exit pulley 28.

Preferably the apparatus of this invention is made of structural metal, e.g., iron, steel, aluminum, or the like, although some components may be plastic or rubber as indicated above.

An advantage of this apparatus over the prior art is that it provides straight aligned forces with no torque applied to the rope pulleys. Another advantage is that the lateral spacing between adjacent carriages 25 may be greater than in the prior art and this permits easier ropes before returning to the dryer cans. Another advantage is that guide pulleys 61A and 61B leading ropes 21A and 21B through nip 62 can be spaced to any location to provide a wider nip as desired. Nip 62 is important when beginning a new length of paper to be dried after a break in the paper sheet or a break in the operation for any reason. A tail of 6–10 inches is usually cut in the paper so that the tail can be led into nip 62 and will pull the entire paper sheet onto the first dryer can in good alignment.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the U.S. is:

1. In a Fourdrinier paper making system wherein a plurality of endless guide ropes are employed on a plurality of dryer cans in a series and said ropes are continuously passed through a stretching device wherein said ropes are continuously stretched; the improvement in the stretching device which comprises a rigid immovable frame having a plurality of elongated parallel tracks with said tracks being generally equal in length and facing each other, each said track containing a reversing pulley mounted on a carriage movable lengthwise along said track and adapted to engage one said rope and cause its direction of travel to change through 180°; an entrance guide pulley adapted to receive said rope from the last in said series of dryer cans and direct it into said reversing pulley; and an exit pulley adapted to receive said rope from said reversing pulley and direct it to the first of said series of dryer cans; and means to apply an adjustable force to each said carriage which produces tension in said rope travelling between said entrance pulley and said exit pulley.

2. The improvement of claim 1 wherein said ropes travelling from said exit pulley to the first of said series of drying cans are separately directed by separate idler pulleys to converge at said first of the series of drying cans so as to form a nip between adjacent said ropes adapted to receive an edge of the paper web travelling toward and over said drying cans in the Fourdrinier process.

3. The improvement of claim 1 wherein a plurality of ropes and of tracks is two.

4. The improvement of claim 1 wherein said adjustable force is provided by gravity acting on a plurality of weights attached to a cable connected to said carriage.

5. The improvement of claim 1 wherein said adjustable force is provided by fluid-actuated piston directed against a cable attached to said carriage.

6. The improvement of claim 1 which additionally comprises an impact bumper disposed laterally across each said track and adapted to receive and absorb the impact of said carriage in the event of breakage of said rope.

7. The improvement of claim 4 which additionally comprises an impact bumper disposed laterally across said track and adapted to receive and absorb the impact of said carriage in the event of breakage of said cable.

8. The improvement of claim 5 which additionally comprises an impact bumper disposed laterally across said track and adapted to receive and absorb the impact of said carriage in the event of breakage of said cable.

9. The improvement of claim 1 wherein each said track includes two parallel spaced structural beams having similar concave recesses aligned and facing each other; and wherein said carriage is movable lengthwise in the space between beams and contains convex guide means that mate with said concave recesses.

10. The improvement of claim 9 wherein said concave recesses are the spaces between the upper and lower flanges of said beams, and said convex guide means is a solid strip of low friction material.

11. The improvement of claim 9 wherein said concave recesses are the spaces between the upper and lower flanges of said beams and said convex guide means is a plurality of tapered rollers.

12. A rope stretching device for use with at least two endless guide ropes driving a plurality of dryer cans in a series of a paper making process wherein the ropes are continuously stretched, said device comprising a rigid immovable frame having at least two elongated parallel tracks generally equal in length and facing each other, a plurality of carriages movable lengthwise along respective said tracks, a reversing pulley mounted on each said carriage and adapted to engage respective of the at least two guide ropes and cause its direction of travel to change through 180°, an entrance guide pulley mounted to said frame and adapted to receive respective of the at least two guide ropes from the last in the series of dryer cans and direct it into respective said reversing pulley, an exit pulley mounted to said frame and adapted to receive respective of the at least two guide ropes from respective said reversing pulley and direct it to the first of the series of dryer cans, and means to apply an adjustable force to each said carriage which produces tension in each of the at least two guide ropes travelling between said entrance pulleys and said exit pulleys.

13. The device of claim 12 wherein said means to apply an adjustable force includes a plurality of weights attached to cables connected to each said carriage.

14. The device of claim 13 further comprising an impact bumper disposed laterally across said tracks for receiving and absorbing any impact of said carriage in the event of breakage of said cable.

15. The device of claim 12 wherein said means to apply an adjustable force includes a fluid-actuated piston and idler pulley directed against a cable attached to respective said carriage.

16. The device of claim 15 further comprising an impact bumper disposed laterally across said tracks for receiving and absorbing any impact of said carriage in the event of breakage of said cable.

17. The device of claim 12 wherein each said track includes two parallel spaced structural beams having recesses aligned and facing each other, said carriage having guide means disposed in said recesses for mounting said carriage for movement lengthwise in the space between beams.

18. The device of claim 17 wherein said recesses are defined by and between upper and lower flanges of said beams, and said guide means is defined by a solid strip of low friction material.

19. The device of claim 17 wherein said recesses are defined by and between upper and lower flanges of said beams and said guide means includes a plurality of tapered rollers.

20. The device of claim 12 further comprising an impact bumper disposed laterally across said tracks for receiving and absorbing impact of said carriage in the event of breakage of said rope.

* * * * *